US009321578B2

(12) United States Patent
Garavaglia et al.

(10) Patent No.: US 9,321,578 B2
(45) Date of Patent: Apr. 26, 2016

(54) POCKET BLADE DISPENSER

(71) Applicant: Pacific Handy Cutter, Inc., Irvine, CA (US)

(72) Inventors: Joseph P. Garavaglia, Newport Beach, CA (US); Brandon L. Spoelstra, Costa Mesa, CA (US); Markus Gropl, Huntington Beach, CA (US)

(73) Assignee: PACIFIC HANDY CUTTER, INC., Irvine, CA (US)

( * ) Notice: Subject to any disclaimer, the term of this patent is extended or adjusted under 35 U.S.C. 154(b) by 0 days.

(21) Appl. No.: 13/843,609

(22) Filed: Mar. 15, 2013

(65) Prior Publication Data

US 2014/0263393 A1 Sep. 18, 2014

(51) Int. Cl.
*B65D 83/10* (2006.01)

(52) U.S. Cl.
CPC ..... *B65D 83/10* (2013.01)

(58) Field of Classification Search
CPC ..... B65D 83/10
USPC ..... 221/185, 30, 246, 268, 276; 206/359; 30/62, 64, 162
See application file for complete search history.

(56) References Cited

U.S. PATENT DOCUMENTS

| | | | | | |
|---|---|---|---|---|---|
| 2,591,855 | A * | 4/1952 | Nicholson | 221/232 |
| 2,641,358 | A * | 6/1953 | Santo | 221/232 |
| 2,928,531 | A * | 3/1960 | Henley | 206/357 |
| 3,286,823 | A * | 11/1966 | Gillespie | 206/39.5 |
| 3,543,918 | A * | 12/1970 | Borden et al | 206/356 |
| 4,114,780 | A * | 9/1978 | Sharon | 221/101 |
| 4,826,042 | A * | 5/1989 | Vujovich | 221/228 |
| 6,250,498 | B1 * | 6/2001 | Lovejoy | 221/185 |
| 6,598,761 | B1 * | 7/2003 | Chou | 221/228 |
| 8,113,347 | B2 * | 2/2012 | Kohring et al. | 206/352 |
| 8,567,641 | B2 * | 10/2013 | Kobayashi | 221/232 |
| 2012/0006844 | A1 * | 1/2012 | Kobayashi | 221/262 |
| 2013/0061479 | A1 * | 3/2013 | Lutgen et al. | 30/329 |

* cited by examiner

*Primary Examiner* — Patrick Mackey
(74) *Attorney, Agent, or Firm* — Henricks, Slavin & Holmes LLP

(57) ABSTRACT

A blade dispenser apparatus includes a body, a blade receptacle coupled to and repositionable in relation to the body, a blade holder coupled to and repositionable in relation to the blade receptacle, and an actuator coupled to the blade holder, the actuator being deployable for repositioning of the blade holder to dispense a blade or for disengaging a portion of the blade receptacle from the body allowing a user of the blade dispenser to access the blade receptacle.

13 Claims, 10 Drawing Sheets

POCKET BLADE DISPENSER

CROSS-REFERENCE TO RELATED APPLICATIONS

This application is related to U.S. Design patent application No. 29/450,242, entitled "Pocket Blade Dispenser" filed herewith know U.S. Design Pat. No. D742,760, issued on Nov. 10, 2015), which is hereby incorporated by reference.

TECHNICAL FIELD

The present invention relates generally to replaceable blades for cutters and devices for dispensing such blades and, in particular, a blade dispenser apparatus with a body (or frame), articulating container portions coupled thereto defining blade receptacles, and a blade shuttle/actuator mechanism configured for safely, and in conjunction with container/body portions interfaces, facilitating various blade dispenser configurations and/or operations.

BACKGROUND ART

A great variety of knives, cutters, safety cutters, and cutter apparatuses are known. Features variously found in prior knives, cutters, safety cutters, and cutter apparatuses include mechanisms and devices facilitating, for example, blade deployment, blade locking, blade depth adjustment, blade change, or blade storage. Various ergonomic devices and apparatuses are also known.

Unfortunately, known blade storage apparatuses and devices are often cumbersome, inconvenient, difficult or tedious to operate, or lacking in features that might improve worker efficiency and/or decrease the likelihood of injuries resulting from contact with blades. Cutters with replaceable blades often present to an operator or user potential hazards associated with blade replacement. In this regard, known blade dispensing apparatuses and devices can likewise be cumbersome or inconvenient, poorly suited for use in relation to particular styles or types of work, or suffer from various other safety and/or operational deficiencies.

It would be useful to be able to provide one or more of: a blade dispenser apparatus with a mechanism or device that facilitates improved, advantageous, or otherwise desirable or useful blade dispensing; a blade storage apparatus with a mechanism or device that facilitates improved, advantageous, or otherwise desirable or useful blade storage; and a blade holder and/or container with a mechanism or device that facilitates improved, advantageous, or otherwise desirable or useful blade holding and/or containment.

SUMMARY OF THE INVENTION

In an example embodiment, a blade dispenser apparatus includes a body, a blade receptacle coupled to and repositionable in relation to the body, a blade holder coupled to and repositionable in relation to the blade receptacle, and an actuator coupled to the blade holder, the actuator being deployable for repositioning of the blade holder to dispense a blade or for disengaging a portion of the blade receptacle from the body allowing a user of the blade dispenser to access the blade receptacle.

In an example embodiment, a blade storage apparatus includes a container with multiple blade storage compartments having a body portion and covers that are pivotally and slidably coupled to the body portion.

In an example embodiment, a blade container apparatus includes a frame and multiple articulating portions (e.g., covers) defining receptacles for blades, at least one of the articulating portions including a blade shuttle configured to dispense a blade.

In an example embodiment, a blade dispenser apparatus includes a body, a container configured for holding blades therein, the container being coupled to and repositionable in relation to the body, a blade holder coupled to and repositionable in relation to the container to dispense a blade, the blade dispenser being configured such that when the blade holder is deployed a portion of the blade dispenser prevents the container from being moved to an opened position.

In an example embodiment, a blade dispenser apparatus includes a body, a container portion configured for receiving blades therein, the container portion being selectively coupled to the body at an engagement interface, a blade shuttle coupled to and repositionable in relation to the container portion, and a release member configured for engaging and disengaging the blade shuttle from the container portion, the body and container portion being configured such that the release member is accessible when the container portion is closed and in a locked position at the engagement interface.

In an example embodiment, a blade dispenser apparatus includes a body, container portions coupled to and repositionable in relation to the body, each of the container portions being configured for receiving blades (when the portion is moved to an opened position), a blade holder coupled to and repositionable in relation to the container portions; and an actuator coupled to the blade holder, the actuator being repositionable in a first direction responsive to which the blade holder dispenses a blade and a second direction responsive to which (a contact surface of) one of the containers is released from a locking engagement with an interface portion of the body.

DISCLOSURE OF INVENTION

Devices and methods described herein involve one or more of, for example: a blade dispenser apparatus with multiple safety features, a blade dispenser with an actuator mechanism deployable for dispensing a blade or allowing access to a blade receptacle, a blade (dispenser and/or) storage apparatus with pivotally and slidably coupled blade storage compartments, a blade (dispenser and/or) container with multiple articulating portions defining receptacles for blades, a blade dispenser apparatus with a blade container that is prevented from being opened when a blade holder of the container is deployed, a blade dispenser apparatus with a repositionable container portion, a blade shuttle, and a release member accessible for activating the blade shuttle when the container portion is closed and in a locked position, and a blade dispenser apparatus with an actuator/blade shuttle mechanism that is selectively deployable mutually exclusively in relation to multiple different operations/actions facilitated by the mechanism.

Figure 1:
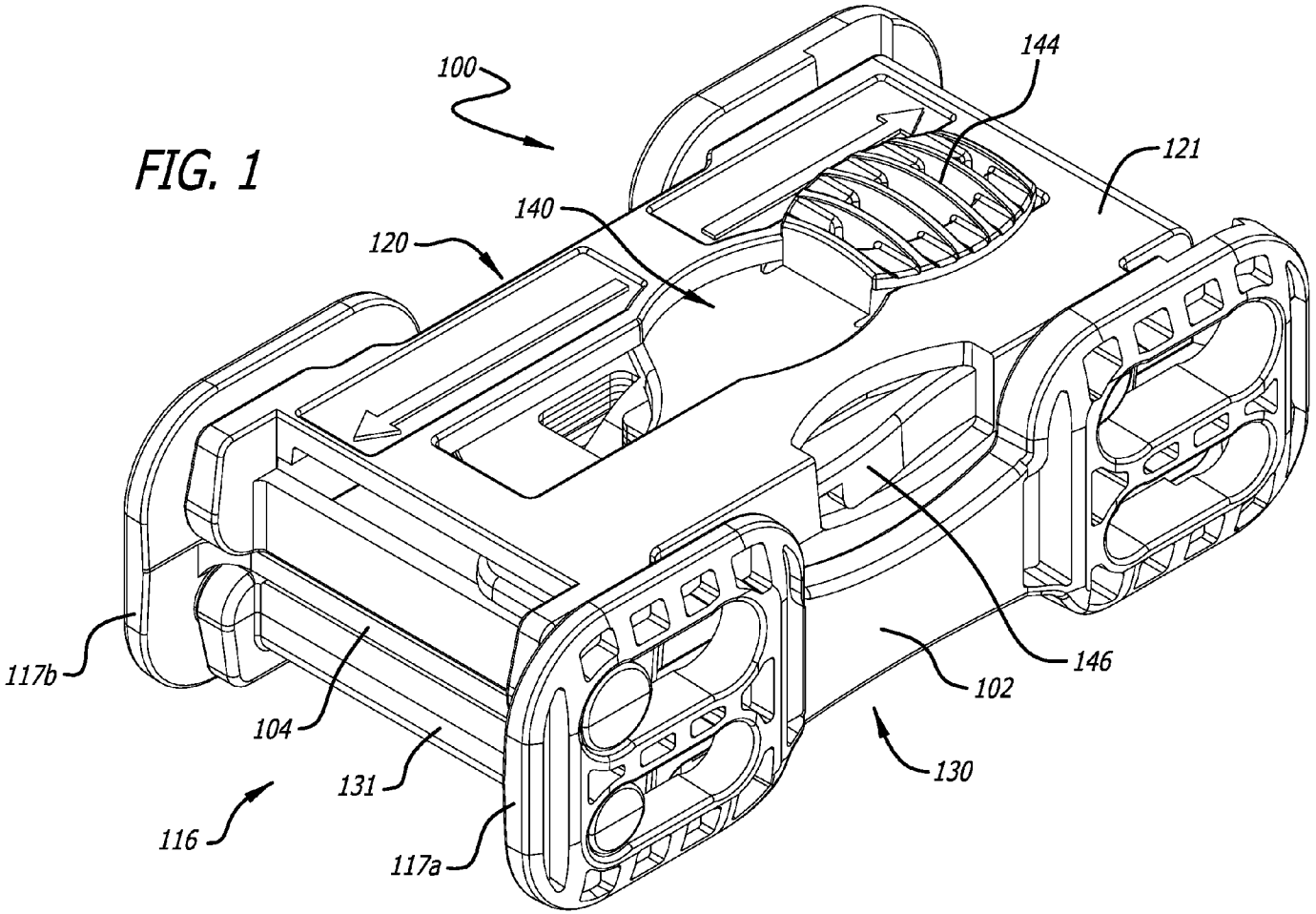
FIG. 1 is a perspective view of an example embodiment of a blade dispenser apparatus.
Figure 2:
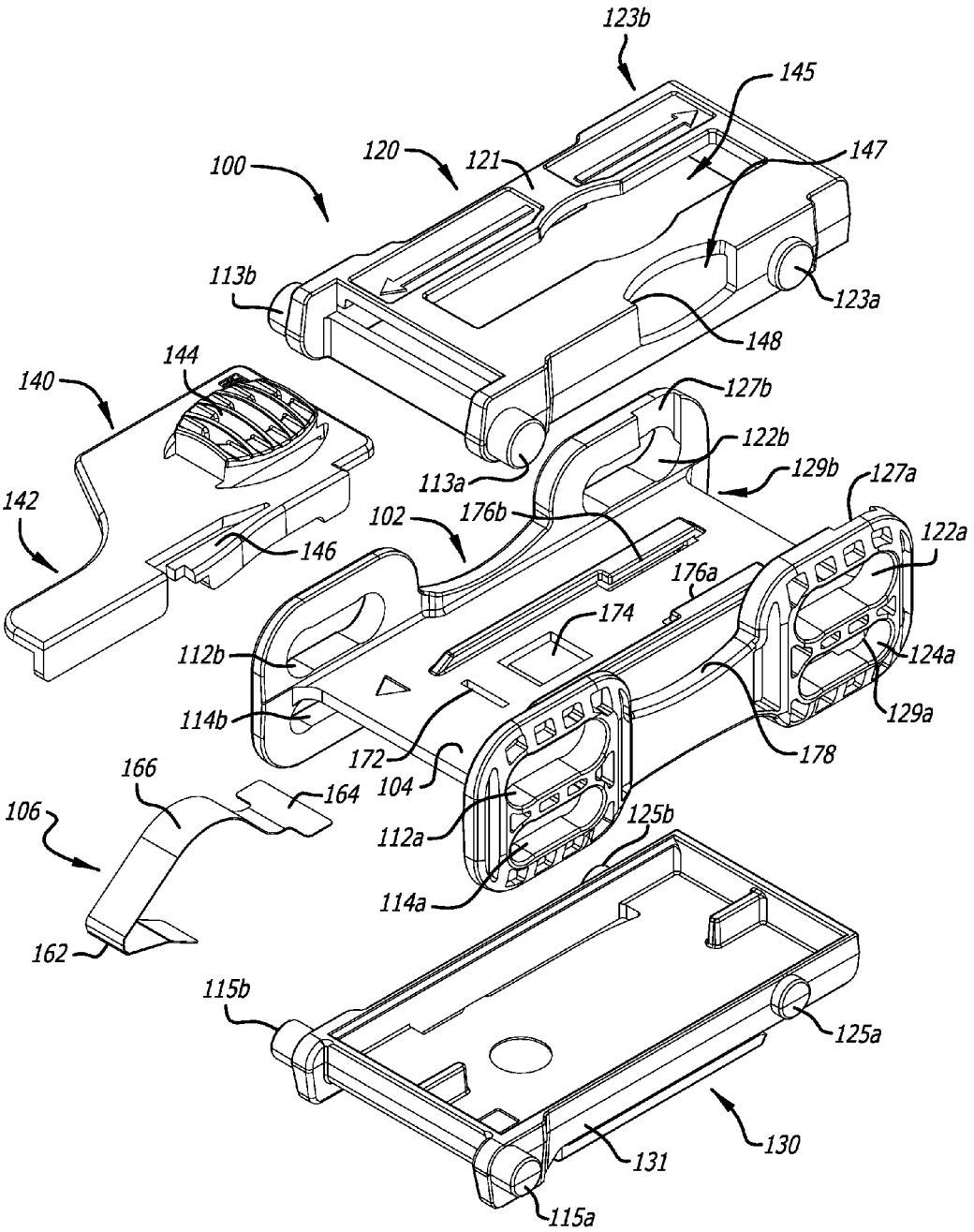
FIG. 2 is an exploded perspective view of the blade dispenser apparatus of FIG. 1.

Referring to FIGS. 1 and 2, in this example embodiment, a blade dispenser 100 includes a body (or frame) 102 having a central portion 104, and a spring 106 (e.g., a leaf spring). The body 102 can be configured (e.g., as shown and described herein) such that the blade dispenser 100 is safe, as well as comfortable, to carry in a smock or pocket. In this example embodiment, the central portion 104 is configured to support/hold a spring (e.g., such as the spring 106) or other mechanism for imparting a biasing force. In this example embodiment, the central portion 104 includes surfaces/portions (e.g., a first pair of channels 112*a* and 112*b*, and a second pair of channels 114*a* and 114*b*) configured to support one or more exterior portions of the blade dispenser. In this example implementation, the channels 112*a*, 112*b*, 114*a*, and 114*b* are configured to allow the blade dispenser 100 to be stood on an end (or side) 116 of the dispenser (which in this example is provided/defined by the portions 117*a* and 117*b* (e.g., substantially flat as shown) adjacent to the channels 112*a*, 112*b*, 114*a*, and 114*b*. In example embodiments, the aforementioned exterior portions of the blade dispenser include one or more blade storage and/or dispensing compartments.

The blade dispenser 100 includes a blade storage compartment 120, e.g., for new (or replacement) blades, that has a cover 121 (e.g., as shown), and a blade storage compartment 130, e.g., for used blades, that has a cover 131 (e.g., as shown). In example implementations, a blade (dispenser and/or) storage apparatus (or other tool) includes or is provided with pivotally and slidably coupled blade storage compartments. In example embodiments, at least one of the covers 121 and 131 is pivotally and slidably coupled to the frame 102. In this example embodiment, the (new blade) cover 121 includes or is provided with interface portions (or surfaces) 113*a* and 113*b* (e.g., cylindrical posts) coupled to the channels 112*a* and 112*b*, respectively. Additionally, the cover 121 includes or is provided with interface portions (or surfaces) 123*a* and 123*b* (e.g., cylindrical posts) coupled to the channels 122*a* and 122*b*, respectively. In its closed position, the cover 121 is secured/locked to the body 102 (providing safe storage for new or replacement blades). In this example embodiment, the portions 123*a* and 123*b* extend a shorter distance from the cover 121 than the portions 113*a* and 113*b*, and the body 102 includes tracks 127*a* and 127*b* (e.g., recessed body portions providing lateral access to the channels 122*a* and 122*b*, respectively) configured (e.g., as shown) to receive and accommodate movement of the portions 123*a* and 123*b* therein. The (used blade) cover 131 includes or is provided with interface portions (or surfaces) 115*a* and 115*b* (e.g., cylindrical posts) coupled to the channels 114*a* and 114*b*, respectively. Additionally, the cover 131 includes or is provided with interface portions (or surfaces) 125*a* and 125*b* (e.g., cylindrical posts) coupled to the channels 124*a* and 124*b*, respectively. In its closed position, the cover 131 is secured/locked to the body 102 (providing safe storage for used blades). In this example embodiment, the portions 125*a* and 125*b* extend a shorter distance from the cover 131 than the portions 115*a* and 115*b*, and the body 102 includes tracks 129*a* and 129*b* (e.g., recessed body portions providing lateral access to the channels 124*a* and 124*b*, respectively) configured (e.g., as shown) to receive and accommodate movement of the portions 125*a* and 125*b* therein. In example embodiments, the frame 102 is configured to facilitate operative connections to one or more articulating portions (e.g., blade storage compartment covers) of the blade dispenser.

In example embodiments, the housing 102 and the covers 121 and 131 are one or more of directly coupled (e.g., in direct contact with each other), indirectly coupled (e.g., coupled together by one or more intermediary coupling elements or components), continuously coupled (e.g., at least one cover repositioning in relation to a continuous portion of the housing 102 as the at least one cover is pivotally repositioned), and intermittently coupled (e.g., at least one cover contacting or engaging different portions of the housing 102 at different times and/or without continuous coupling or surface contact as the at least one cover is repositioned in relation to the housing or a portion thereof).

The interface portions (and corresponding channels) for the new and used blade compartments can be configured with different diameters (e.g., as in this example implementation) to prevent assemblers from securing (or attempting to secure) the covers 121 and 131 at an interface intended for the other cover.

Figure 3:
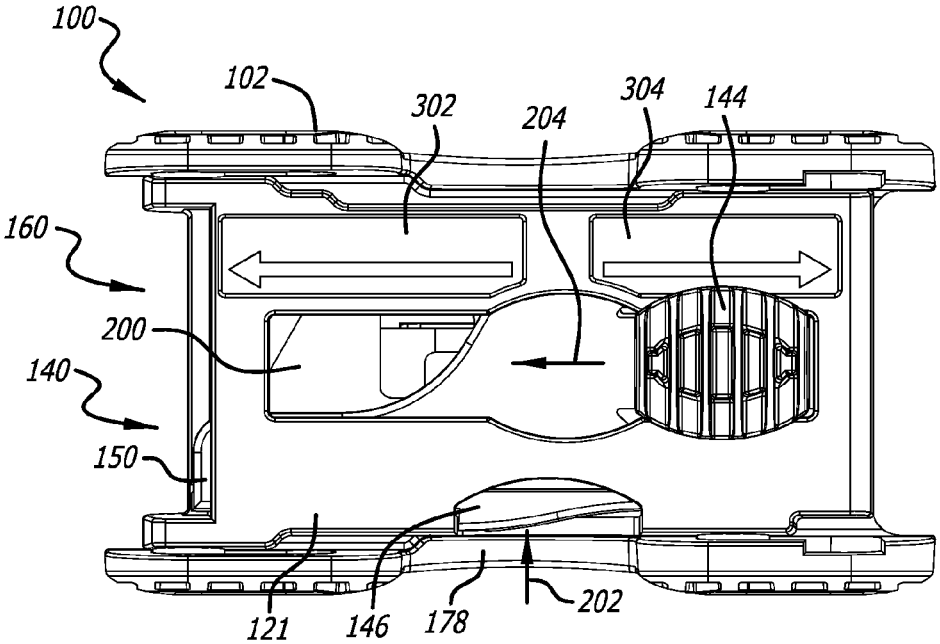
FIG. 3 is a top view of the blade dispenser apparatus of FIG. 1 showing the new blade storage compartment (of the dispenser) in its engaged/locked position, the blade shuttle (of the compartment) also being shown in its respective engaged/locked position.

The blade dispenser 100 includes a blade shuttle 140 which, in this example embodiment, is slidably coupled to the cover 121 at inside portions thereof. The shuttle 140 includes a blade holder 142, an actuator 144 (e.g., a button) extending through an opening 145 of the cover 121, and a shuttle release 146 (e.g., an integrally-formed latch such as shown) extending through an opening 147 of the cover 121. In this example embodiment, the opening 147 includes a stop surface 148 that engages the shuttle release 146 when the blade shuttle 140 is in its secured position (as shown in FIG. 3).

In example embodiments, the blade shuttle 140 and the cover 121 are one or more of directly coupled (e.g., in direct contact with each other), indirectly coupled (e.g., coupled together by one or more intermediary coupling elements or components), continuously coupled (e.g., at least one portion of the blade shuttle 140 repositioning in relation to a continuous portion of the cover 121 as the blade shuttle 140 is repositioned to dispense a blade), and intermittently coupled (e.g., the release member 146 of the blade shuttle 140 engaging and disengaging from the stop 148 of the cover 121 at different times and/or without continuous coupling or surface contact during an operation of dispensing a blade).

In example implementations, a blade dispenser apparatus (or other tool) includes or is provided with a blade container that is prevented from being opened when a blade holder of the container is deployed. In this regard, by way of example, the blade holder 142 includes a main portion 150 (facing a blade or blades held within the compartment 120) and a side portion 151 (facing the cutting edge(s) of the blade or blades). In this example implementation, surfaces of the main portion 150 and the side portion 152 contacting/transporting the blade(s) are approximately at a right angle to each other, and slidably interface with complementary portions of the cover 121. Surfaces (or portions) of the cover 121 and the blade shuttle 140 are configured to provide a blade dispensing opening 160 and a side opening 161 (see FIG. 13) from which the main portion 150 and the side portion 151 extend, respectively, during a new blade dispensing operation or process. As a safety feature, in this example implementation, the blade dispenser is configured such that the opening 160 (from which new blades are dispensed) is at, or faces, the end (or side) 116 of the dispenser. When the (new blade storage compartment) cover 121 is pivoted open (after the cover 121 has been slid to its unlocked position; see e.g., FIG. 8), a portion 209 of the body 104 faces the opening 160 of the new blade storage compartment 120.

In example implementations, a blade (dispenser and/or) container (or other tool) includes or is provided with multiple articulating portions (such as, for example, the covers 121 and 131 which are pivotally and slidably coupled to the body portion) defining receptacles for blades.

Thus, in an example embodiment, a blade storage apparatus includes a container with multiple blade storage compartments having a (shared) body portion and (independently repositionable) covers that are pivotally and slidably coupled to the body portion. In an example embodiment, the blade storage apparatus further includes an actuator configured to facilitate dispensing a blade held in one of the blade storage compartments.

Thus, in an example embodiment, a blade container apparatus includes a frame and multiple articulating portions (e.g., covers) defining receptacles (e.g., separate compartments) for blades, at least one of the articulating portions including a blade shuttle configured to dispense a blade (from a blade dispenser opening defined by the frame and one or more of the receptacles). In example embodiments, the frame defines a portion of each of the receptacles, and different receptacles are defined by each of the articulating portions, respectively. In example embodiments, the articulating portions are independently-repositionable covers of the receptacles. In example embodiments, at least one of the articulating portions is pivotally and slidably coupled to the frame. In example embodiments, at least one of the articulating portions is movable to an opened position at which the articulating portion and a portion of the frame provide a base for stabilizing the blade container with said articulating portion in the opened position.

Figure 4:
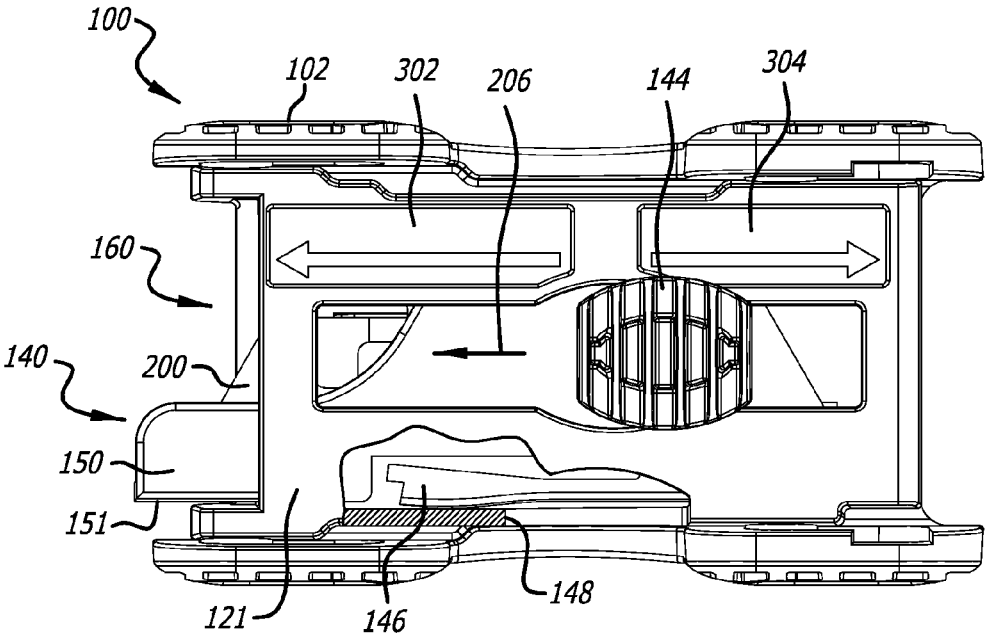
FIG. 4 shows the release member of the blade dispenser apparatus disengaged, and the blade shuttle and blade (carried by the shuttle) extending from the new blade storage compartment (responsive to the actuator button being repositioned distally) during a blade dispensing operation.
Figure 5:
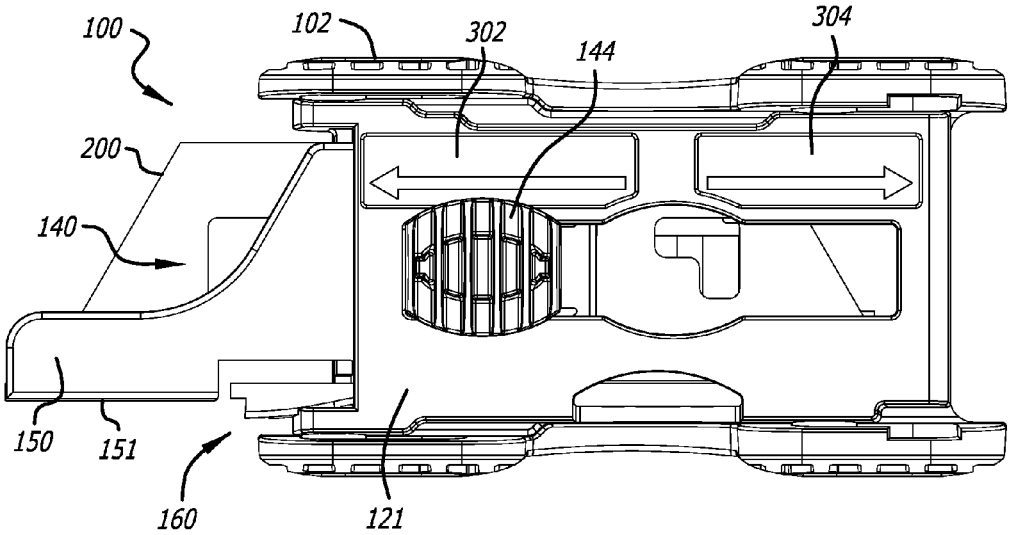
FIG. 5 shows the blade shuttle in its fully deployed position dispensing a blade from the new blade storage compartment.

Referring to FIG. 3, with the cover 121 distally positioned, the shuttle release 146 is accessible via a recess 178 in the frame 102. A user of the blade dispenser 100 can impart a first force (denoted by the arrow 202) with his or her thumb, for example, against a side portion of the release 146 and begin to reposition the release 146 flexing it inward toward the blade; however, a second force (denoted by the arrow 204) cannot extend the distal end of the blade shuttle 140 from the opening 160 until the release 146 is pushed inward a sufficient distance to clear the stop 148 (as shown in FIG. 4). After the shuttle release 146 is disengaged, the blade shuttle 140 can be slidably extended (as denoted by the arrow 206) using the actuator 144 to a fully-extended position (FIG. 5).

In example implementations, a blade dispenser apparatus (or other tool) includes or is provided with a repositionable container portion, a blade shuttle, and a release member accessible for activating the blade shuttle when the container portion is closed and in a locked position.

Thus, in an example embodiment, a blade dispenser apparatus includes a body, a container portion configured for receiving blades therein, the container portion being selectively coupled to the body at an engagement interface, a blade shuttle coupled to and repositionable in relation to the container portion, and a release member configured for engaging and disengaging the blade shuttle from the container portion, the body and container portion being configured such that the release member is accessible (e.g., via a recess or opening in the body) when the container portion is closed (in relation to the body) and in a locked position at the engagement interface. In example embodiments, the blade dispenser apparatus further includes an actuator configured to facilitate user controlled actions including repositioning the container portion (in relation to the body) and dispensing a blade held on the blade shuttle.

With regard to materials, the body 102, the new blade cover 121, the used blade cover 131, and the blade shuttle 140 can be formed of various materials, for example, a thermoplastic that has high strength, rigidity, and impact resistance (e.g., Acrylonitrile butadiene styrene (ABS)), and by various processes (e.g., injection molding). The spring 106 (e.g., a leaf spring) can be formed of various materials, for example, a material made of or including a metal (or a metal alloy or a plastic) that has high strength and wear resistance (e.g., spring steel), and by various processes (e.g., die stamping).

In example implementations, a blade dispenser apparatus (or other tool) includes or is provided with an actuator mechanism (e.g., coupled to or integrally formed with a blade holder) deployable for dispensing a blade or allowing access to a blade receptacle.

Thus, in an example embodiment, a blade dispenser apparatus includes a body, a blade receptacle coupled to and repositionable in relation to the body, a blade holder coupled to and repositionable in relation to the blade receptacle, and an actuator coupled to the blade holder, the actuator being deployable for repositioning of the blade holder to dispense a blade or for disengaging a portion of the blade receptacle from the body allowing a user of the blade dispenser to access the blade receptacle. In example embodiments, the blade receptacle is configured for holding and dispensing blades through an opening defined by portions of the body and the blade receptacle.

In this example embodiment, the blade dispensing opening 160 is sized such that only one blade at a time can be extended from the new blade storage compartment 120 with the distal end (i.e., the portions 150 and 152) of the blade shuttle 140. The spring 106 feeds subsequent new blades into the blade shuttle 140 when it is retracted. Accordingly, the blade dispenser reduces worker injury by safely dispensing one blade at a time.

Figure 6:
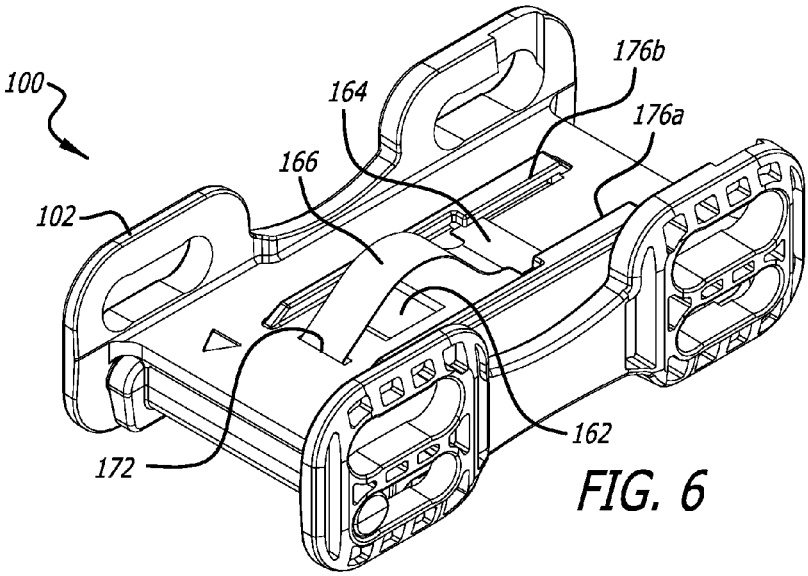
FIG. 6 is another perspective view of the blade dispenser apparatus, the new blade storage compartment being removed to show a central portion of the body (or frame) and a spring coupled to the central portion.

Referring to FIGS. 2 and 6, in this example embodiment, the spring 106 includes a securing portion 162, an interface portion 164, and a blade contact portion 166 (e.g., as shown) and is operatively connected to the body portion 104 (of the frame 102) and configured such that the blade contact portion 166 imparts a force biasing a blade or blades held within the new blade storage compartment 120 toward the blade shuttle 140. The body portion 104 includes or is provided with surfaces (or portions) configured to secure the spring 106 relative to the body and to allow a portion of the spring to reposition. In this example implementation, the body 104 includes a slot 172 and a retention surface 174 configured to hold the securing portion 162, and guides 176*a* and 176*b* configured to receive the interface portion 164 facilitating a slidable interface (between the body and the spring) that allows the blade contact portion 166 to flatten when the cover 121 is moved to its closed position. In example implementations, the spring 106 is configured such that it imparts sufficient force to (at least partially) push the posts 123*a* and 123*b* upward along the tracks 127*a* and 127*b*, respectively (that is, after a user of the blade dispenser disengages/unlocks the new blade storage compartment 120 by moving the cover 121 proximally).

Portions of the blade dispenser can be utilized to provide information in the form of, for example, text, images, symbols, icons, or a combination thereof. The information can include user instructions (e.g., for specific operations or for a particular step of an operation), vendor information, or advertisements. In this example implementation, the areas 302 and 304 (e.g., provided on the cover 121 as shown) provide visual indications of the direction toward which the cover 121 is to be repositioned in relation to dispensing a new blade and gaining access to the new blade compartment, respectively.

In example implementations, engagement interfaces between (and/or surfaces of) the frame 102 and the cover 121 are configured such that it is difficult for a user (e.g., a typical or average user) to manually reposition the cover 121 without using the actuator 144. In example embodiments, the blade dispenser 100 is configured such during an operation (or process) of gaining access to the new blade compartment 120, even if the shuttle release 146 is inadvertently depressed, a user's utilization of the actuator 144 to reposition (as denoted by the arrow 208; see FIG. 7) the cover 121 necessarily precludes utilization of the actuator (i.e., pushing the actuator in the opposite direction) in the manner required to dispense a blade from the new blade storage compartment 120. Moreover, such implementations preclude the blade dispensing operation requirement of disengagement of the shuttle release 146 from the stop 148 and simultaneous deployment of the actuator 144 (i.e., repositioning of the actuator 144 distally; see again FIG. 4). Thus, in example embodiments, utilization of the actuator 144 is mutually exclusive in relation to performing different operations (or processes) associated with the blade dispenser (e.g., an action or actions associated with the operations of dispensing a new blade and gaining access to the new blade compartment, respectively).

Figure 7:
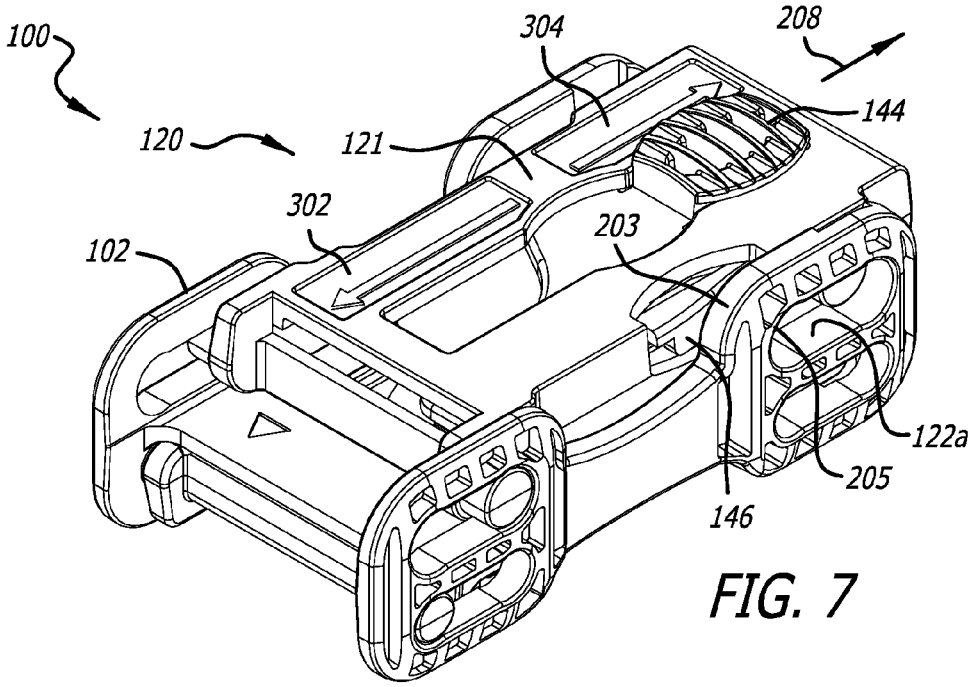
FIG. 7 shows the new blade storage compartment being repositioned proximally to a disengaged/unlocked position.
Figure 8:
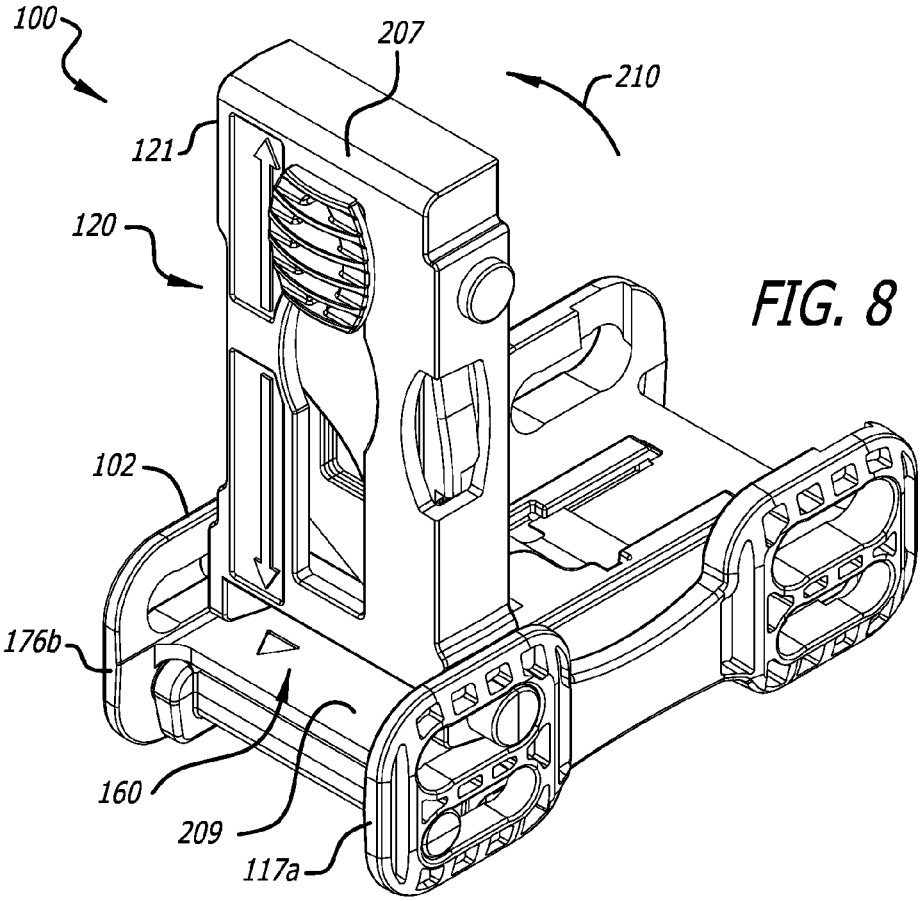
FIG. 8 shows the cover of the new blade storage compartment pivotally repositioned away from the central body portion.

Referring to FIG. 7, in this example implementation, the frame 102 is configured (e.g., with portions/surfaces 203 adjacent to the distal end 205 of the channel 122*a*) to obstruct access to the shuttle release 146 after the cover 121 has been repositioned to disengage (unlock) the new blade storage compartment 120. Thus, initially during an operation (or process) of gaining access to the new blade storage compartment 120, access to the shuttle release 146 (deployment of which is necessary to dispense a blade from the compartment 120) is substantially obstructed. Referring to FIG. 8 (further with regard to the operation of gaining access to the new blade storage compartment 120), after the cover 121 has been repositioned to disengage (unlock) the new blade storage compartment 120, the cover 121 can be repositioned (as denoted by the arrow 210) to its opened position. New (or replacement) blades are loaded into or removed from the dispenser by sliding the cover 121 back, and then hinging it upwards. The blade storage compartment 120 can be configured, for example, to hold up to five blades.

Figure 9:
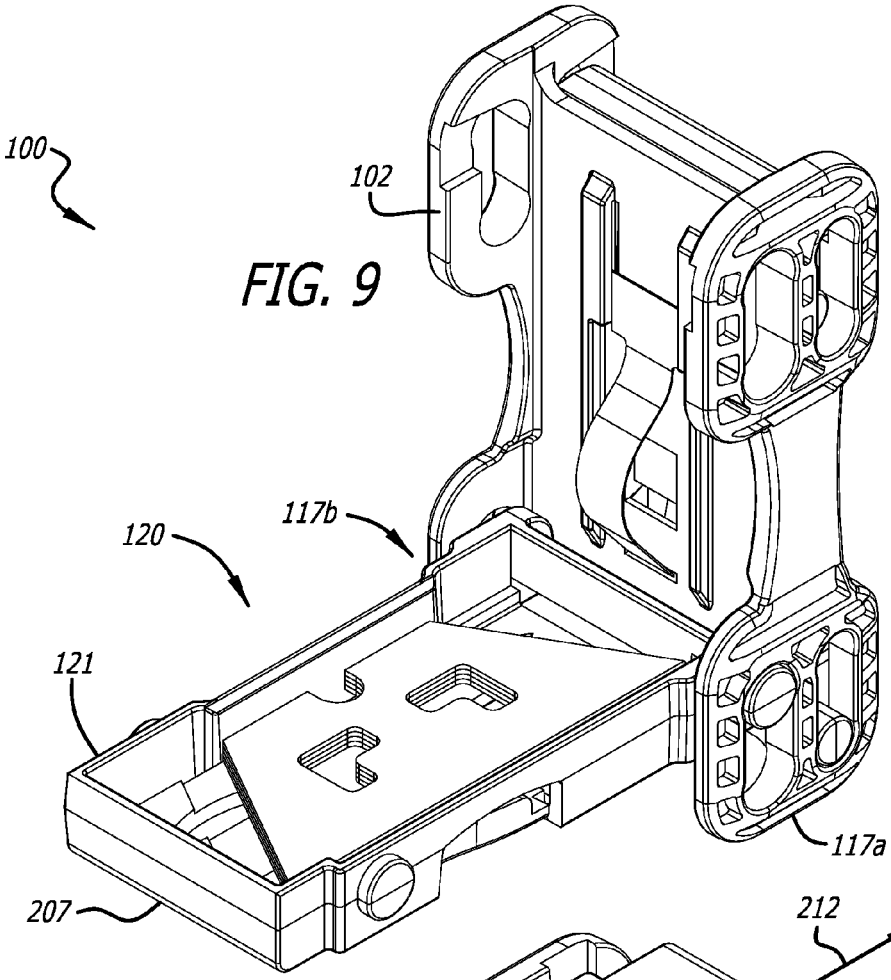
FIG. 9 shows the cover of the new blade storage compartment in an opened position providing a user with access to the compartment.

As an added safety feature, the blade dispenser is configured such that either or both of the (blade storage compartment) covers are repositionable to a support position (e.g., a fully opened position) (e.g., in which an end portion 207 of the cover 121 occupies a location approximately in the plane defined by the portions 117*a* and 117*b*; FIG. 9) which steadies the dispenser while also ensuring that the opened compartment is facing upward thereby lessening the chance of a blade inadvertently falling out of the opened compartment (providing safety benefits, among others, keeping blades off floors).

Figure 10:
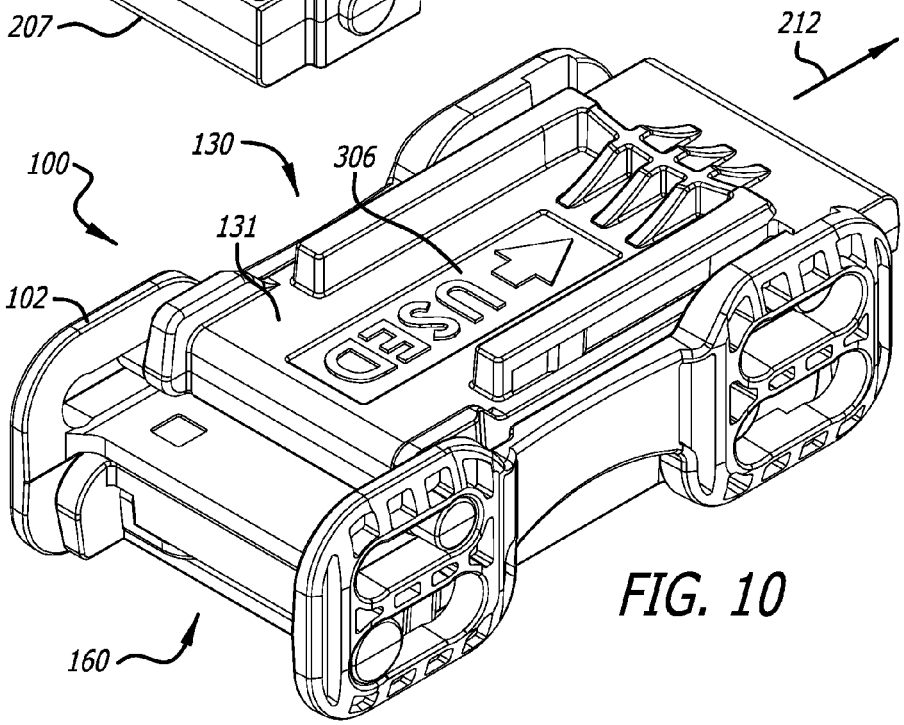
FIG. 10 shows the used blade storage compartment being repositioned proximally to a disengaged/unlocked position.
Figure 11:
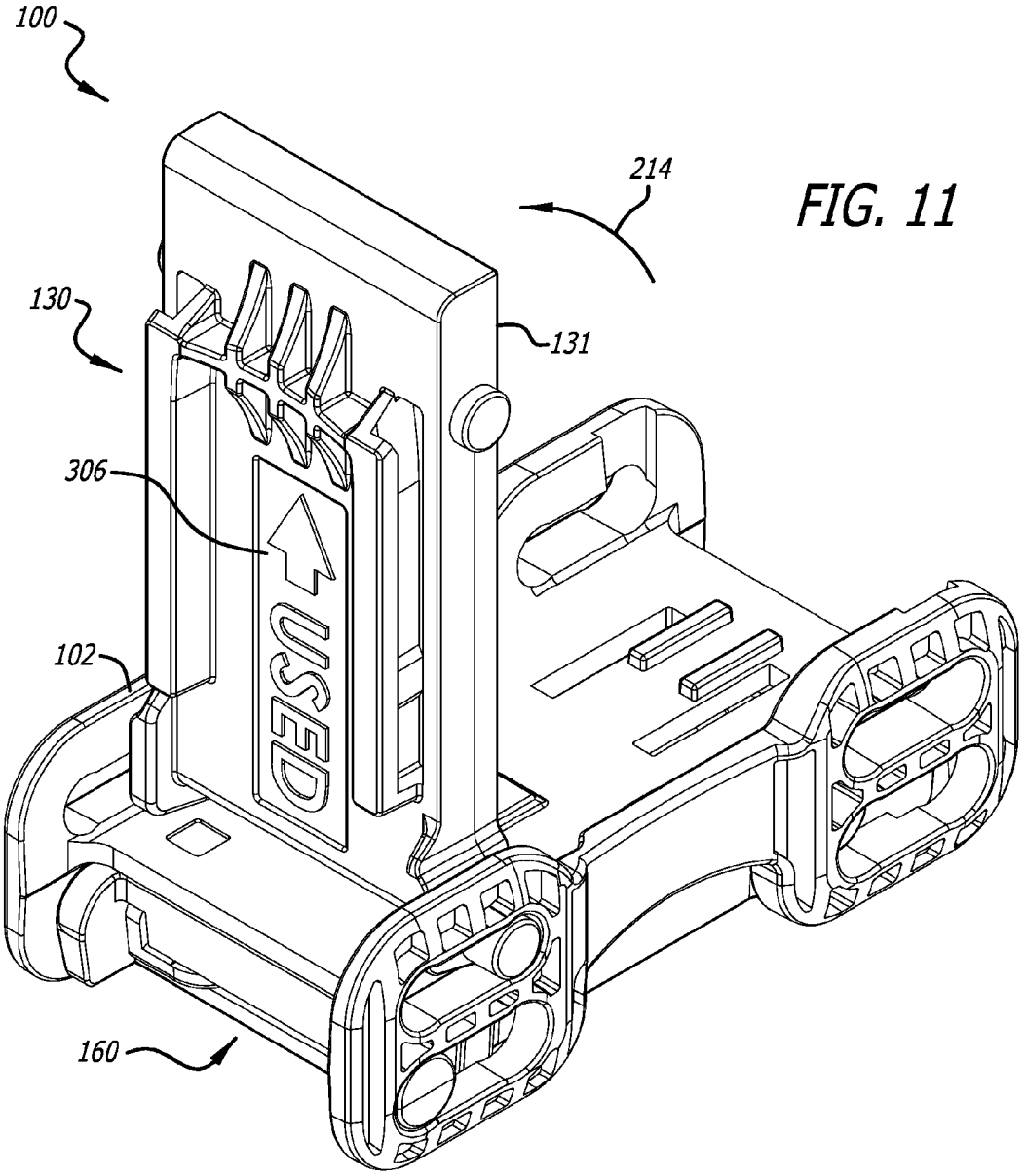
FIG. 11 shows the cover of the used blade storage compartment pivotally repositioned away from the central body portion.
Figure 12:
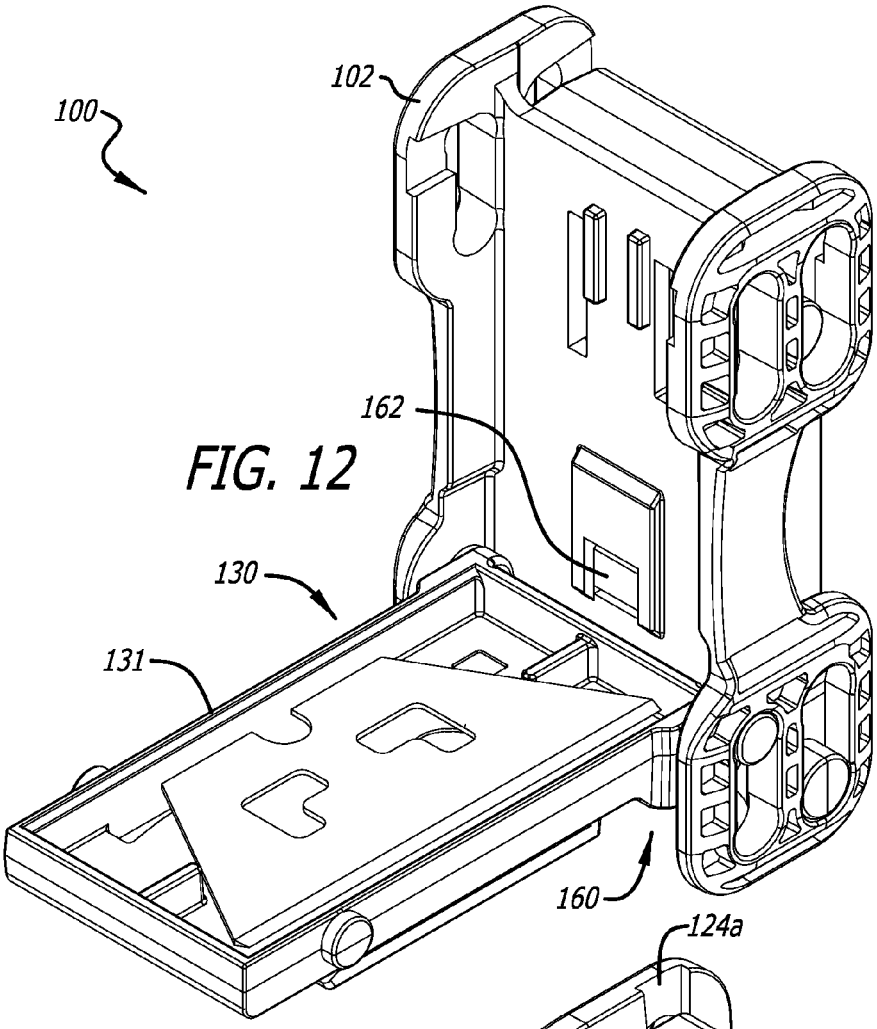
FIG. 12 shows the cover of the used blade storage compartment in an opened position providing a user with access to the compartment.

Referring to FIGS. 10-12, an operation (or process) of gaining access to the used blade storage compartment 130 is now described. After the cover 131 has been repositioned (as denoted by the arrow 212; FIG. 10) to disengage (unlock) the used blade storage compartment 130, the cover 131 can be repositioned (as denoted by the arrow 214; FIG. 11) to its opened position. In this example implementation, the area 306 (e.g., provided on the cover 131 as shown) provides a visual indication of the direction toward which the cover 131 is to be repositioned in relation to gaining access to the used blade compartment. Used blades are loaded into or removed from the dispenser by sliding the cover 131 back, and then hinging it upwards. The used blade storage compartment 130 can be configured, for example, to hold up to five blades.

As an additional safety feature, when the (used blade storage compartment) cover 131 is pivoted open to a support position (FIG. 12), the opening 160 faces downward (e.g., toward a tabletop or other flat surface) thereby decreasing the chance of an inadvertently dispensed a new blade.

Thus, in an example embodiment, a blade dispenser apparatus includes a body, a container configured for holding blades therein, the container being coupled to and repositionable in relation to the body, a blade holder (or shuttle) coupled to and repositionable in relation to the container to (engage and) dispense a blade (from the container), the blade dispenser being configured such that when the blade holder is deployed (or partially deployed) (contact between the blade holder and) a portion (e.g., a contact portion) of the blade dispenser prevents the container from being moved (in relation to the body) to an opened position. In example embodiments, the blade dispenser apparatus further includes an actuator coupled to the blade holder, the actuator being repositionable for repositioning the container (in relation to the body) and dispensing a blade held on the blade holder (from a blade dispenser opening). In example embodiments, the blade dispenser apparatus further includes a release member operatively connected to the blade holder (extending from an opening in the container portion), the body and container portion being configured such that the release member is accessible when the container portion is in a closed position (in relation to the body).

In example implementations, a blade dispenser apparatus (or other tool) includes or is provided with an actuator/blade shuttle mechanism that is selectively deployable mutually exclusively in relation to multiple different operations/actions facilitated by the mechanism.

Thus, in an example embodiment, a blade dispenser apparatus includes a body, container portions coupled to and repositionable in relation to the body, each of the container portions being configured for receiving blades (when the portion is moved to an opened position), a blade holder coupled to and repositionable in relation to the container portions; and an actuator coupled to the blade holder, the actuator being repositionable in a first direction responsive to which the blade holder dispenses a blade and a second direction responsive to which (a contact surface of) one of the containers is released from a locking engagement with an interface portion of the body.

Figure 13:
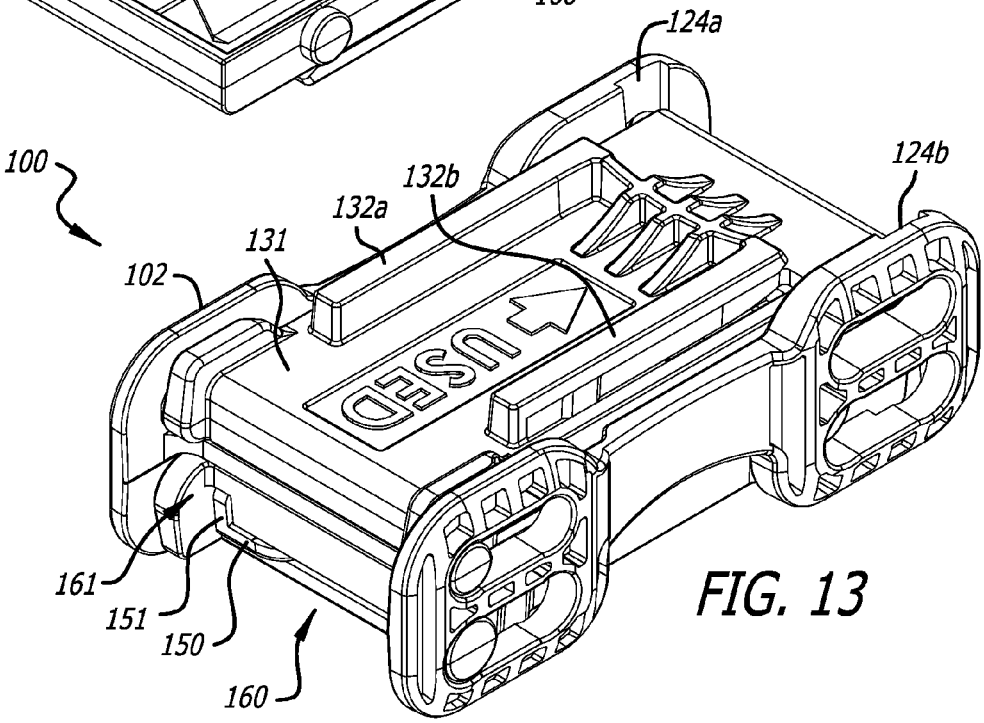
FIG. 13 shows the used blade storage compartment positioned distally at its engaged/locked position.
Figure 14:
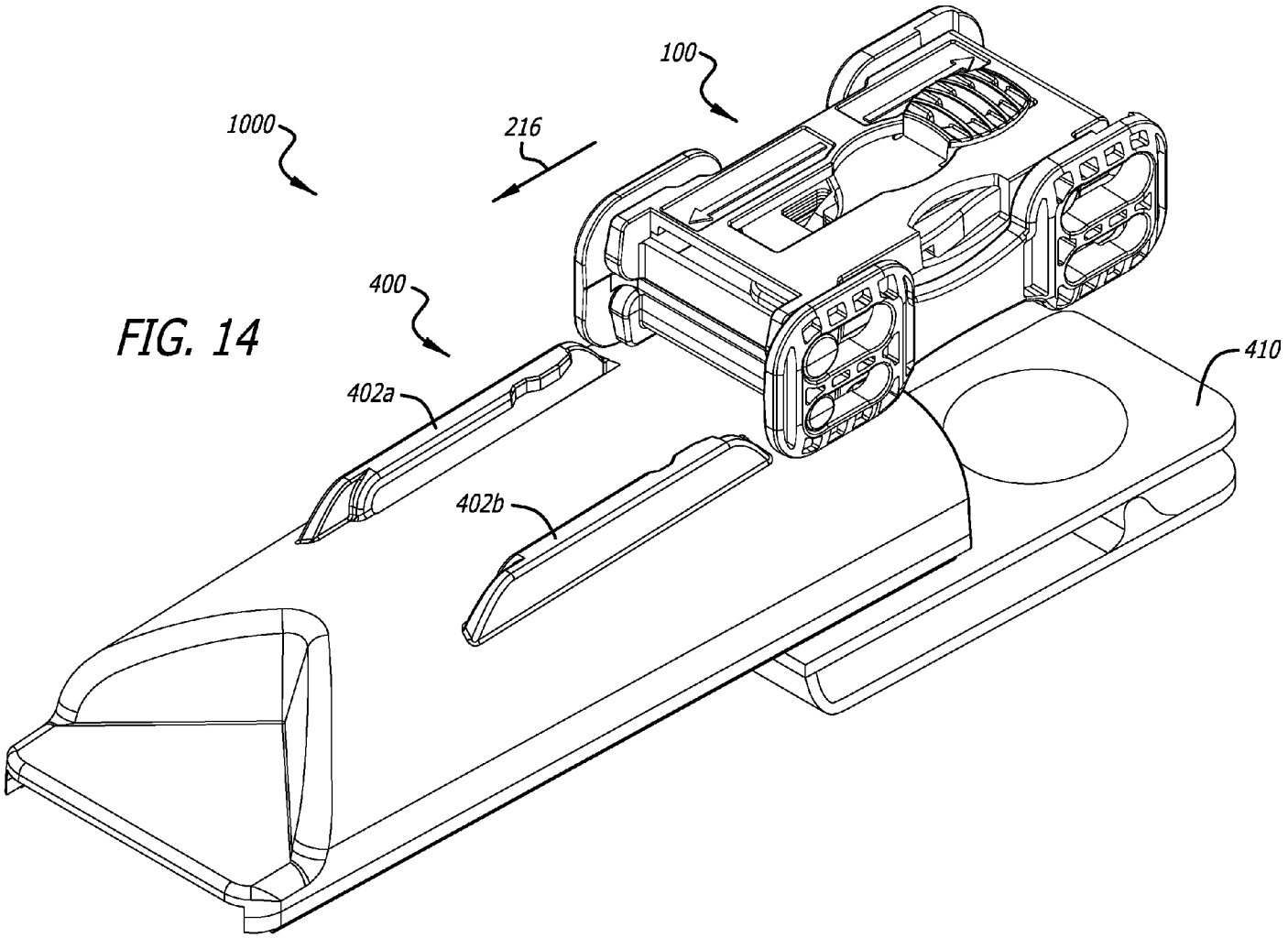
FIG. 14 is a perspective view of an example embodiment of a tool system including the blade dispenser apparatus of FIG. 1 and a holster, showing the blade dispenser being repositioned for engagement with the holster.
Figure 15:
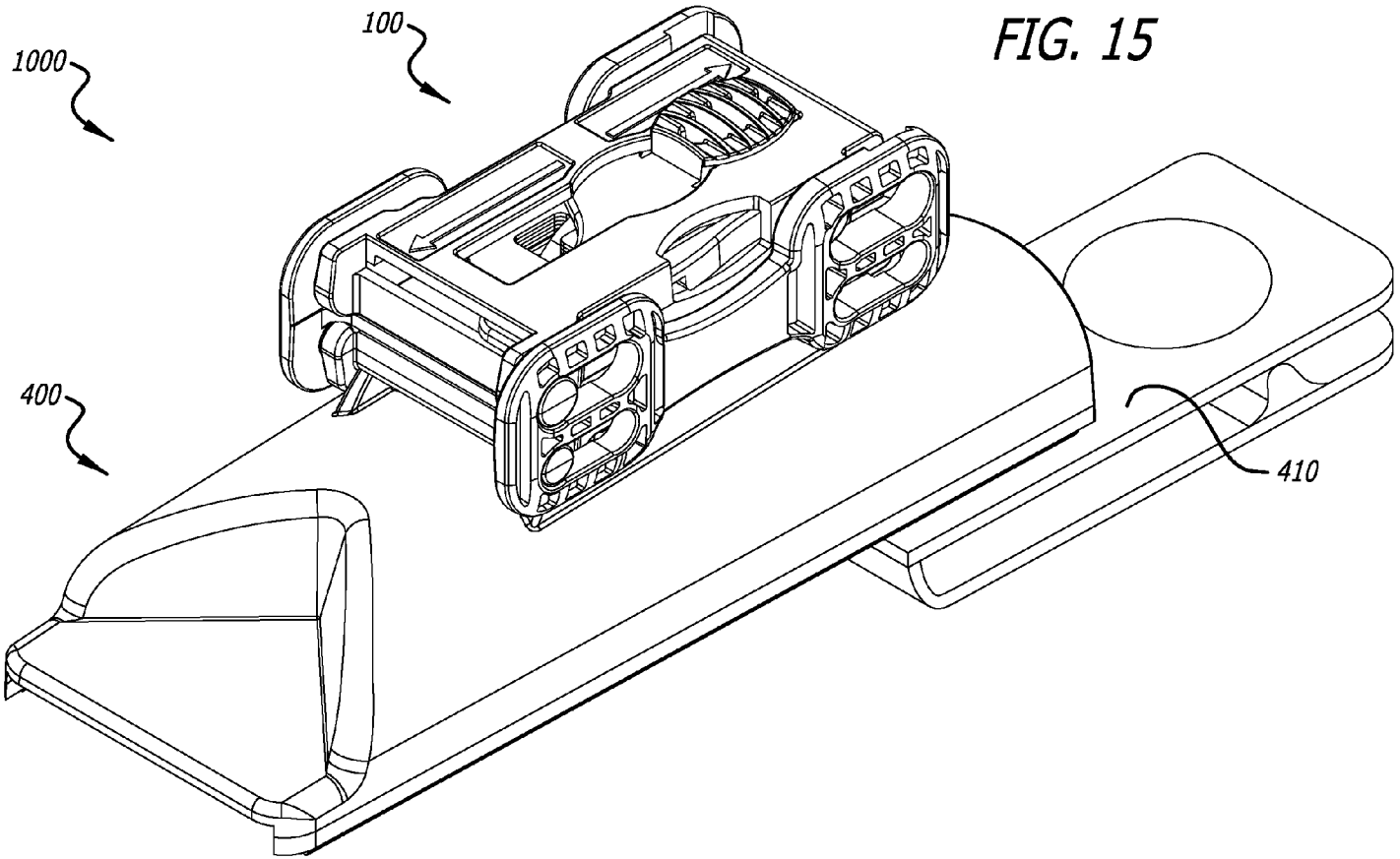
FIG. 15 shows the tool system of FIG. 14 with the blade dispenser attached to the holster.

Referring to FIG. 13, in this example implementation, the cover 131 includes or is provided with rails 132*a* and 132*b* (e.g., as shown). Referring to FIGS. 14 and 15, in example embodiments, a system 1000 includes a blade dispenser and/or storage device (such as, for example, the blade dispenser 100) and a holster or other receptacle or container configured for carrying a knife or other tool. In this example, a holster 400 includes or is provided with surfaces (or portions) 402*a* and 402*b* configured to engage with the rails 132*a* and 132*b*, respectively, to secure together or attach (as denoted by the arrow 216; FIG. 14) the blade dispenser 100 and the holster 400. In example implementations, the holster 400 includes or is provided with a clip 410 (e.g., for securing the holster to a belt or other object).

In example embodiments, a blade dispenser (or system including a blade dispenser) includes or is provided with an interface (e.g., at a blade storage compartment portion thereof) configured for securing the blade dispenser to a holster or other receptacle or container configured for carrying a knife or other tool. In example implementations, the interface is provided at on a cover for a blade storage compartment.

In example embodiments, a "container" utilized in relation to blades, such as a blade dispenser apparatus (or blade storage apparatus or blade container) includes or is provided with attachment surfaces (or portions) (e.g., at an exterior portion thereof), and further includes a holster (or other receptacle or container configured for carrying a knife or other tool) configured to hold (e.g., support and/or securedly engage) the container utilizing the attachment surfaces.

Accordingly, in relation to embodiments herein, the actuator can be deployed for both attaching and separating the container from the holster safely and conveniently without concern over accidentally dispensing a blade. Moreover, attachment surfaces of the container such as, for example, the rails 132*a* and 132*b*) can be reversed (e.g., 180 degrees) in relation to an alternative embodiment in which the distal end, where the opening 160 is located, faces the upper portion of the holster 400 (rather than the bottom portion of the holster as shown in FIG. 15).

In example embodiments, the container or a portion thereof includes or is provided with attachment surfaces, and a holster is configured to hold the container utilizing the attachment surfaces. In example embodiments, the container includes or is provided with attachment surfaces, and the container and the holster are configured such that the container, when held by the holster, is oriented such that a path along which the container repositions in relation to the attachment surfaces is substantially parallel to a path along which the actuator (of the container) repositions when deployed. In example embodiments, the holster includes or is provided with surfaces (or portions) (e.g., rails 402*a* and 402*b*) configured to engage (e.g., receive and/or interface with) complementary surfaces (or portions) of the container.

In example embodiments, a blade dispenser apparatus (e.g., in the form of a pocket-friendly secured container) includes or is provided with an interface (e.g., at one of the blade storage compartments) configured for securing the container to a holster. In example embodiments, the blade dispenser apparatus includes or is provided with attachment surfaces (e.g., including a pair of substantially parallel surfaces) configured to engage complementary surfaces of a holster or other receptacle or container configured for carrying a knife or other tool. In example embodiments, the attachment surfaces are located on one of the blade storage compartments (e.g., a blade storage compartment for used blades).

Although the present invention(s) has(have) been described in terms of the example embodiments above, numerous modifications and/or additions to the above-described embodiments would be readily apparent to one skilled in the art. It is intended that the scope of the present invention(s) extend to all such modifications and/or additions.

What is claimed is:

1. A blade dispenser apparatus comprising:

a body;

a container configured for holding blades therein, the container being coupled to and repositionable in relation to the body;

a blade holder coupled to and repositionable in relation to the container to dispense a blade, the blade dispenser being configured such that when the blade holder is deployed a portion of the blade dispenser prevents the container from being moved to an opened position; and a release member operatively connected to the blade holder;

wherein the body and container are configured such that the release member is accessible when the container is in a closed position.

2. The blade dispenser apparatus of claim 1, further comprising:

an actuator coupled to the blade holder, the actuator being selectively deployable for repositioning of the blade holder to dispense a blade from the blade receptacle and for disengaging a portion of the blade receptacle from the body allowing a user of the blade dispenser to access the blade receptacle.

3. The blade dispenser apparatus of claim 1, wherein the container is configured for holding and dispensing blades through an opening defined by portions of the body and the container.

4. The blade dispenser apparatus of claim 1, wherein the container includes or is provided with attachment surfaces configured to engage complementary surfaces of a holster configured for carrying a knife or other tool.

5. The blade dispenser apparatus of claim 4, wherein the container, when held by the holster, is oriented such that a path along which the container repositions in relation to the attachment surfaces is substantially parallel to a path along which the actuator repositions when deployed.

6. The blade dispenser apparatus of claim 1, further comprising:

an actuator coupled to the blade holder, the actuator being selectively deployable for mutually exclusively facilitating operations of dispensing a blade held on the blade holder and gaining access to the container.

7. The blade dispenser apparatus of claim 1, further comprising:

an actuator coupled to the blade holder, the actuator being repositionable for repositioning the container and dispensing the blade held on the blade holder from the container.

8. A blade dispenser apparatus comprising:

a body;

container portions coupled to and repositionable in relation to the body, each of the container portions being configured for receiving blades;

a blade holder coupled to and repositionable in relation to the container portions; and an actuator coupled to the blade holder, the actuator being repositionable in a first direction responsive to which the blade holder dispenses a blade held on the blade holder and a second direction responsive to which one of the containers is released from a locking engagement with an interface portion of the body.

9. The blade dispenser apparatus of claim 8, wherein the container portions are pivotally and slidably coupled to the body.

10. A blade dispenser apparatus comprising:

a body;

a container portion configured for receiving blades therein, the container portion being selectively coupled to the body at an engagement interface;

a blade shuttle coupled to and repositionable in relation to the container portion; and a release member configured for engaging and disengaging the blade shuttle from the container portion, the body and container portion being configured such that the release member is accessible when the container portion is closed and in a locked position at the engagement interface.

11. The blade dispenser apparatus of claim 10, further comprising:

an actuator configured to facilitate user controlled actions including repositioning the container portion and dispensing a blade held on the blade shuttle.

12. The blade dispenser apparatus of claim 10, wherein the container portion includes or is provided with attachment surfaces configured to engage complementary surfaces of a holster or other receptacle or container configured for carrying a knife or other tool.

13. The blade dispenser apparatus of claim 12, wherein the attachment surfaces include a pair of substantially parallel surfaces.

* * * * *